US007604731B2

(12) United States Patent
Bhattacharyya et al.

(10) Patent No.: US 7,604,731 B2
(45) Date of Patent: Oct. 20, 2009

(54) PROCESS FOR THE PRODUCTION OF NEEDLE COKE

(75) Inventors: Debasis Bhattacharyya, Haryana (IN); Satheesh Vetterkunnel Kumaran, Haryana (IN); Bandaru Venkata Hari Prasad Gupta, Haryana (IN); Pramod Kumar, Haryana (IN); Asit Kumar Das, Haryana (IN); Gadari Saidulu, Haryana (IN); Satyen Kumar Das, Haryana (IN); Gurpreet Singh Kapur, Haryana (IN); Veena Bansal, Haryana (IN); Venkatachalam Krishnan, Haryana (IN); Satish Makhija, Haryana (IN); Sobhan Ghosh, Haryana (IN); Niranjan Raghunath Raje, Haryana (IN)

(73) Assignee: Indian Oil Corporation Limited, Mumbai (IN)

( * ) Notice: Subject to any disclaimer, the term of this patent is extended or adjusted under 35 U.S.C. 154(b) by 104 days.

(21) Appl. No.: 10/892,024

(22) Filed: Jul. 15, 2004

(65) Prior Publication Data

US 2005/0284793 A1 Dec. 29, 2005
US 2007/0181462 A2 Aug. 9, 2007

(30) Foreign Application Priority Data

Jun. 25, 2004 (IN) ..... 683/MUM/2004

(51) Int. Cl.
*C10G 51/02* (2006.01)
*C10G 9/00* (2006.01)

(52) U.S. Cl. ..... 208/67; 208/50; 208/72; 208/76; 208/106; 208/128; 208/130; 208/131

(58) Field of Classification Search ..... 208/50, 208/67, 72, 76, 128, 130, 106, 131
See application file for complete search history.

(56) References Cited

U.S. PATENT DOCUMENTS 2,775,549 A 12/1956 Shea
2,922,755 A 1/1960 Hackley
3,326,796 A * 6/1967 Muller ..... 208/50
3,472,761 A 10/1969 Cameron
3,617,480 A 11/1971 Keel
3,759,822 A 9/1973 Folkins
3,959,115 A 5/1976 Hayashi et al.
4,049,538 A 9/1977 Hayashi et al.
4,075,084 A 2/1978 Skripek et al.
4,108,798 A 8/1978 Sze et al.
4,130,475 A 12/1978 Cameron et al.
4,177,133 A * 12/1979 Hayashi et al. ..... 208/50
4,466,883 A 8/1984 Eickemeyer et al.
4,547,284 A * 10/1985 Sze et al. ..... 208/50
4,551,232 A * 11/1985 Calderon et al. ..... 208/92

FOREIGN PATENT DOCUMENTS

JP 58-025385 2/1983

* cited by examiner

*Primary Examiner*—Glenn Caldarola
*Assistant Examiner*—Prem C. Singh
(74) *Attorney, Agent, or Firm*—Clark & Elbing LLP

(57) ABSTRACT

A process is disclosed for producing needle coke from heavy atmospheric distillation residues having sulfur no more than 0.7 wt %, which process involves the steps of heating the feedstock to a temperature in the range of 440 to 520° C. for thermal cracking in a soaking column under pressure in the range of 1 to 10 kg/cm$^2$ to separate the easily cokable material, separating the cracked products in a quench column and a distillation column and then subjecting the hydrocarbon fraction from the bottom of the quench column and a hydrocarbon fraction having a boiling point in the range of 380 to 480° C. from the distillation column and/or any other suitable heavier hydrocarbon streams in a definite ratio depending on certain characteristic parameters to thermal cracking in a second soaking column at a temperature of 460 to 540° C., pressure in the range of 2 to 20 kg/cm$^2$ in presence of added quantity of steam for formation of a mesophase carbonaceous structure which on steam stripping and cooling forms a solid crystalline coke suitable for manufacturing of graphite electrode of large diameter having co-efficient of thermal expansion lower than $1.1\times10^{-6}$/° C. measured on graphite artifact in the temperature range of 25 to 525° C.

14 Claims, No Drawings

PROCESS FOR THE PRODUCTION OF NEEDLE COKE

CROSS REFERENCE TO RELATED APPLICATIONS

This application claims benefit of Indian Patent Application No. 683/MUM/2004, filed Jun. 25, 2004.

FIELD OF THE INVENTION

The present invention relates to a process for the production of needle coke suitable for manufacturing of graphite electrodes having lower co-efficient of thermal expansion, from heavier petroleum fractions obtained from bottom of the atmospheric distillation column through two stages or two modes delayed thermal coking of varying severity levels.

BACKGROUND OF THE INVENTION

Delayed coking is a well-established process in the industry, which produces more desirable lighter distillates along with petroleum coke from petroleum residuum (bottoms from atmospheric and vacuum distillation of crude oil). Delayed coking has become more important in recent years due to the declining demand of fuel oil, deteriorating crude quality and also rising crude prices. In most of the refineries, the process is considered as a residue disposal unit, but the same process has also been found to be an excellent route for the production of premium grade or needle coke from certain selected feedstocks.

Needle coke, named for its needle-like structure, is the highest value petroleum coke used for manufacturing graphite electrode for arc furnaces. A large-sized artificial graphite electrode requires lower coefficient of thermal expansion as well as electrical resistivity, high density and a high level of physical strength, in order to cope with the operation of steel-making electric arc furnace. The material, consequently, should contain a large quantity of the so-called needle coke having needle-like crystalline structure of easily and readily graphitizable nature.

A number of factors, such as sulfur content, hardness, metals content, electrical resistivity and coefficient of thermal expansion, determine the quality and value of needle coke. Although each of these factors is important, the primary measure of product quality is the linear coefficient of thermal expansion, or CTE. The value of this measurement, in order for the product to be designated a premium coke, is not precise, but it is generally considered that a CTE of less than about $5.0\times10^{-7}/°$ C. (measured in the temperature range of 0 to 50° C.) is sufficient to designate the product as premium coke. However, the lower the CTE, the better, and in some cases, a batch of product having particularly low CTE may be useful in blending product to produce an overall CTE of $5.0\times10^{-7}/°$ C. or whatever the designated specification might be.

Hitherto, premium coke has customarily been produced in Delayed cokers from coal tar pitch and thermal tars. However, there is an insufficiently limited supply of coal tar pitch for the demand of the modern industry. Thermal tars are produced by the thermal cracking of virgin, thermally cracked, and catalytically cracked gas oils. Attempts to make premium coke from gas oil without first thermally cracking the gas oil have generally been unsuccessful. The lack of success in producing premium coke without thermally cracking the feedstock, combined with the inability to accurately identify and quantify components in coker feedstocks, has led the industry to the belief that a thermal cracking operation is needed in conjunction with a coker installation in order to produce premium coke. The trend of increased use of fluid catalytic cracking (FCC) units in place of thermal cracking units had forced the industry to search for a feedstock for delayed coking that does not require a thermal cracking step prior to coking. FCC decant oil has been found to be suitable for needle coke formation along with other aromatic rich streams. In addition to this, aromatic extract has also being used as feed constituents for production of needle coke.

U.S. Pat. No. 2,775,549 to Shea discloses an early process for making premium coke from certain petroleum residues. In U.S. Pat. No. 2,922,755 to Hackley, a process is disclosed wherein reduced crude can be mixed with thermal tar to produce a mixture which results in a premium grade coke upon carrying out the delayed coking process provided that this reduced crude is present in the weight percent range of about 10 to about 30. A process for the simultaneous manufacture of regular and premium coke is described in U.S. Pat. No. 3,472,761 to Cameron.

U.S. Pat. No. 3,759,822 describes a method for producing premium coke comprising coking a blend of a thermally or catalytically cracked heavy oil having a high aromatic content with a quantity of a pyrolysis tar obtained from the high temperature cracking of petroleum distillates to produce olefins under conventional coking conditions.

U.S. Pat. No. 4,130,475 describes a process for producing needle coke from a fresh feedstock having a specified gravity, carbon residue and boiling distribution and incorporating thermal tar, internally produced through thermal cracking of gas oil obtained from delayed coking as a supplement to the fresh feed. Japanese Pat. No. 58025385 describes a process for production of needle coke using the extract of the thermally cracked residue of heavy petroleum oil where extraction is carried out using a cracked distillate as solvent and the solvent is not recovered from the extract.

U.S. Pat. No. 4,466,883 describes a process for the production of an improved grade of needle coke using a feedstock comprising selected proportions of a pyrolysis furnace oil and hydro-desulfurized blend of a clarified oil and a lubricating oil extract employing the steps of heat soaking in presence of 20-200 ppm of sulfur, flashing to separate the pitch as residue, fractionation of the flashed oil to afford a cokable bottom fraction and subjecting the cokable bottom fraction to delayed coking.

U.S. Pat. No. 4,075,084 discloses a process of producing needle coke from specific aromatic mineral oil feedstocks through fractionation and hyrdofining of the major lighter fraction and subsequent blending of the heavier fractions obtained thereof.

As per U.S. Pat. No. 4,108,798, a highly crystalline coke can be prepared by heat-soaking a petroleum feedstock which is selected from the group consisting of virgin crude oil, distillation residues, cracked residues and hydro-desulfurised distillation and cracked residues in the presence of 30-200 ppm added dissolved sulfur at a temperature more than 230° C., separating non-crystalline substances as pitch, recovering a heavy cokable residue from the pitch free feed, and subjecting the residue to delayed coking.

In coking processes described in the previously mentioned patents, as well as other variations of the basic coking process, feedstocks normally comprise blend of residual oil viz., thermal cracker residue, FCC decant oil, extract, etc., which have been obtained from various processing steps prior to introduction to the coker. The properties of these feedstocks prior to coking is subject to variation even when they have been sourced from similar processing units due to the likely variation and upsets in the operation. In many cases, for unexplained reasons, product quality has failed to meet specifications even though the feedstock was from the same origin as earlier feedstocks, which produced high quality product.

Moreover, worldwide, there are refineries, especially those of smaller capacity, that do not have any thermal cracker for gas oil feedstock or FCC or an extraction unit. As per the prior art of the needle coke production as disclosed by the patents, these refineries would not be able to produce the needle coke since, in general, thermal cracker residue, FCC decant oil and extract have been used at different proportions to make the needle coke feedstock. It was our endeavor to discover a process whereby without having the units of thermal cracker, FCC or extraction unit, production of needle coke is possible with minimum variation in coke quality.

In this line, a process for producing both non-crystalline and high-crystalline petroleum cokes directly from a virgin crude oil having a sulfur content of lower than 0.4% by weight by a two-stage process is disclosed in the U.S. Pat. No. 3,959,115 by Hayashi et al. In this process, virgin crude oil is preheated in a tube heater to a temperature of 460-520° C. under a pressure of 5-20 kg/cm$^2$, and then subjected flashing into a coking drum at a temperature of 410° C.-430° C. under a pressure of 2-10 kg/cm$^2$ to produce a non-crystalline coke. The heavy residue thus obtained undergoes second stage coking to produce crystalline coke. The process uses virgin crude oil as feed to avoid deposition of coke on the inner wall of heater tubes at the conditions of temperature and time of the heat soaking step. The yield of reduced crude oil (RCO) is in general in the range of 30 to 50 wt % of virgin crude depending on the type and source. Therefore, when the entire crude is considered for delayed coking, the quality of distillate products are inferior in terms of more olefins in gasoline and more aromatics and olefins in kerosene and gas oil range products as compared to those obtained from atmospheric distillation process. Also, the operating expenditure for such a process is expected to be much higher. Therefore, in the era of stringent product quality, the process for production of needle coke using crude oil as feed has several obvious disadvantages.

A variant of the above-mentioned process by the same author as disclosed in U.S. Pat. No. 4,049,538 proposes a process for the production of high crystalline coke by adopting a step of heating and soaking the feedstock in a tube heater in the presence of basic compounds, introducing the heated feedstock to a flashing column for removing non-crystalline substances as pitch, fractionating the distillate from the fractionating column to obtain a heavy residue which is subjected to delayed coking to form a high crystalline coke. In this process, the complete removal of non-crystalline material is difficult since it is based on separation in the flashing column. If the cutting in the flashing column is deep to assure the removal of non-crystalline substances, this will result in lowering in both the yield and quality of coke obtained in the coking stage. Moreover, the alkali metal compound used in the heat soaking step will end up in the pitch, the disposal of which is highly difficult.

A similar process is disclosed in U.S. Pat. No. 3,617,480 which describes a process for producing high quality petroleum coke through segregation of a high boiling gas oil fraction from the products of the coking of a petroleum residuum and subsequently processing the same heavy oil fraction under delayed coking conditions to produce superior quality petroleum coke. In this process, it is very difficult to achieve the quality of the crystalline coke from different types of petroleum residues from varying sources since there is no inbuilt mechanism to monitor the quality of feed for the second stage coking which is reflected in considerably high coefficient of thermal expansion, a critical parameter that determines the quality of needle coke. In our opinion, the coke produced from heavy gas oil type of stream cannot meet the stringent CTE specification of today's premium needle coke.

According to the present invention, we provide a process for producing high crystalline needle coke suitable for manufacturing graphite electrodes using heavy atmospheric distillation residues having sulfur no more than 0.7 wt % which is in general not suitable for direct production of needle coke having CTE of less than $1.1\times10^{-6}$/° C. by any methods described in the prior art processes. The process of this invention employs two stages or two modes of delayed coking scheme of different reaction severities wherein the reaction severity in the first stage or mode facilitates the formation of at least two fractions of predetermined characteristics and the second stage or mode favors the formation of mesophase crystalline structure in the coke. When employed in a preferred sequence of process steps, the process of the present invention affords a needle coke having superior physical properties, including a very low co-efficient of thermal expansion.

OBJECTS OF THE PRESENT INVENTION

Accordingly, the main object of the present invention is to propose a novel process for producing crystalline needle coke suitable for manufacturing graphite electrodes using heavier petroleum fraction obtained from the bottom of the atmospheric crude distillation column.

Another object is to provide a two stage delayed coking scheme that enables the production of crystalline needle coke without requiring any feed pre-treatment or any other petroleum or coal derived hydrocarbon streams from other processing units, viz., Fluid Catalytic Cracking, Extraction, Thermal Cracking, etc.

Yet another object of the invention is to provide a two stage or two mode delayed coking scheme that minimizes the yield of heavier bottom fraction, which is of lower value, and constituents of fuel oil pool.

A further objective is to minimize the yield of non-crystalline coke usually produced through the conventional delayed coking using the heavier petroleum fraction obtained from bottom of the atmospheric distillation column.

SUMMARY OF THE INVENTION

According to the present invention, there is provided a novel process for manufacturing crystalline petroleum needle coke suitable for graphite electrode manufacturing using petroleum based heavy fractions obtained from the bottom of an atmospheric distillation column having sulfur of no more than 0.7 wt % which is in general not suitable for direct production of needle coke by any methods described in the prior art processes. The process of this invention employs two stages or two modes of a delayed coking scheme of different reaction severities wherein the reaction severity in the first stage or first mode facilitates the formation of at least two fractions of predetermined characteristics and the second stage or second mode favors the formation of mesophase crystalline structure in the coke. When employed in a preferred sequence of process steps, the process of the present invention affords a needle coke having superior physical properties, including a very low co-efficient of thermal expansion.

In the present invention, needle coke is produced from atmospheric residue having sulfur of no more than 0.7 wt % following the steps comprising processing the said heavy petroleum fraction in Delayed coking unit under specific operating conditions, quenching the hydrocarbon product vapors in a separate quench column using gas oil from Delayed coking operation, sending the remaining unquenched vapors from the said quench column into a fractionator column, mixing a particular heavier hydrocarbon fraction obtained from the said fractionator and the heavier hydrocarbon fraction from the said quench column in a definite ratio to meet certain predetermined characteristics, subjecting the mixed hydrocarbon fraction to second stage or second mode of Delayed coking under specific operating conditions which is in general less severe than those of the first stage or first mode.

DETAILED DESCRIPTION OF THE INVENTION

A process for preparing crystalline or semi-crystalline petroleum coke having a needle like structure suitable for manufacturing high temperature graphite electrodes from atmospheric residue obtained from bottom of atmospheric crude distillation column, said process comprising the steps:

(a) preheating the atmospheric residue to a temperature in the range of 440 to 520° C.;

(b) carrying out a step of thermal cracking of the heated atmospheric residue obtained in step (a) in a first coking column to form cracked hydrocarbon vapors and easily cokable material and separating the easily cokable material from the cracked hydrocarbon vapors as solid coke;

(c) adding quench stream e.g. heavy coker gas oil to the cracked hydrocarbon vapors obtained in step (b) in a quench column to obtain a condensate containing heavier hydrocarbon fraction vapors containing lighter hydrocarbon fractions;

(d) separating the vapor containing lighter hydrocarbon fraction into at least a gas component and a hydrocarbon fraction having true boiling point in the range of 380° C.-480° C. in a distillation column;

(e) mixing the condensate obtained in the step (c), the hydrocarbon fraction having boiling point in the range of 380-480° C. thus obtained in step (d) and optionally clarified oil (CLO) obtained from FCC process and/or thermal tars and/or aromatic extract and heating the mixture in a preheater to a temperature in the range of 460 to 540° C., and (f) passing steam through the heated mixture of step (e) for carrying out a step of thermally cracking the same in a second coking column thereby obtaining crystalline petroleum coke having needle structure and a cracked hydrocarbon product mixture and separating the crystalline petroleum coke having needle structures.

In an embodiment of the present invention, the atmospheric residue is obtained from bottom of atmospheric crude distillation and contains sulfur content less than or equal to 0.7 wt %, conradson carbon residue less than or equal to 12 wt % and aromatics content greater than or equal to 25 wt %.

In another embodiment of the present invention wherein in step (b), thermal cracking is carried out in the first coking column under pressure in the range of 1 to 10 kg/cm$^2$ (g).

In yet another embodiment of the present invention wherein in step (b), thermal cracking is carried out for a cycle time in the range of 16 to 32 hrs.

In still another embodiment of the present invention wherein in step (e), the amount of the condensate, the hydrocarbon fraction having boiling point in the range of 380-480° C. and optionally clarified oil, termal tar, aromatic extract, etc. used are adjusted such that the aromatics content of the mixture is greater than or equal to 60%.

In one more embodiment of the present invention, the amount of the condensate, the hydrocarbon fraction having boiling point in the range of 380-480° C. and optionally clarified oil, termal tar, aromatic extract, etc. used are adjusted such that "average aromatic ring per molecules" of the mixed hydrocarbon fraction is in the range of 3 to 8.

In one another embodiment of the present invention, the amount of the condensate, the hydrocarbon fraction having boiling point in the range of 380-480° C. and optionally clarified oil, termal tar, aromatic extract, etc. used are adjusted such that the content of n-heptane insoluble molecules of the mixed hydrocarbon fraction comes not more than 0.5 wt %.

In a further embodiment of the present invention, any entrained coke particles in the hydrocarbon fraction obtained from the bottom of the quench column is removed through filtration or centrifugation or both.

In a further more embodiment of the present invention wherein in step (f), the pressure in the second coking column is in the range of 2 to 20 kg/cm$^2$ (g).

In another embodiment of the present invention wherein in step (f), the velocity of the entering hydrocarbon fraction in the second coking column is in the range of 20 to 200 feet/sec.

In yet another embodiment of the present invention wherein in step (f), the steam is passed through the second coking column after switching off the flow of the heated mixture of step (e) for a period not less than 2 hrs.

In still another embodiment of the present invention, the velocity of the steam in the second coking column is kept in the range of 4 to 14 feet/sec.

In one more embodiment of the present invention, the first and the second coking columns may be physically same, but the operations are carried out in two different modes.

In one another embodiment of the present invention, the cracked hydrocarbon product obtained is distilled in a distillation column to obtain heavy gas oil, LPG, naphtha and cracked hydrocarbon gas.

In a further embodiment of the present invention, the heavy gas oil obtained in step (d), for quenching the cracked hydrocarbon vapors.

In a further more embodiment of the present invention, the cracked hydrocarbon product obtained in step (f) is recycled, up to a recycle to fresh feed ratio of 0.1 to 2.

Needle coke is a high value product from the petroleum industry, which is used to manufacture graphite electrodes used in the steel industry. Worldwide, needle coke is produced from different feedstocks, which are pre-treated before processing in the Delayed-coking unit. The pre-treatment causes the cost of the needle coke production very high.

The present invention generally relates to the process for upgrading and increasing the value added to the heavier petroleum fraction of low API gravity and higher mean average boiling point without requiring any costly feed pre-treatment processes. Alternative dispositions of these materials are limited, since such fractions have low market value. Such hydrocarbons are not easily fully upgraded or converted to products having higher market values. The process of this invention is particularly related to production of highly crystalline needle coke suitable for manufacturing of graphite electrodes using a heavier bottom fraction from an atmospheric distillation column employing the conventional delayed coking unit hardware. The feedstock for the process of the present invention is a fresh heavy petroleum fractions obtained from the bottom of atmospheric crude distillation column having Conradson carbon residue of less than 12 wt %, n-heptane insoluble of 1-5 wt % and sulfur of no more than 0.7 wt %. From the prior art information and also from experience of operating delayed coker unit, it is quite clear that production of needle coke is not achieved using such feedstocks.

We have discovered a new process for producing needle coke from a heavy petroleum fraction of specific properties having sulfur content less than 0.7 wt %, comprising processing the heavy petroleum fraction in Delayed coking unit under specific operating conditions, quenching the hydrocarbon product vapors in a separate quench column using gas oil from Delayed coking operation, sending the remaining unquenched vapors from the said quench column into a fractionator column operating under atmospheric pressure, mixing the heavier hydrocarbon fraction obtained from the said fractionator and the heavier hydrocarbon fraction from the said quench column in a definite ratio to meet certain predetermined characteristics, subjecting the mixed hydrocarbon fraction to second stage or mode of Delayed coking under specific operating conditions which is in general less severe than those of the first stage or mode.

We have also found that the operating conditions in the first and second stage or mode Delayed coking and the mixing ratio of the heavier hydrocarbon fraction obtained from the said fractionator column and the heavier hydrocarbon fraction from the said quench column have direct impact on the quality of the needle coke produced in the second stage or mode of Delayed coking. Certain characterization parameters of the combined feed to the second stage or mode coking as measured through Nuclear magnetic resonance spectroscopy (NMR) technique have been found to be necessary for achieving the improved quality of the needle coke. Thus, these properties of the heavier hydrocarbon fractions obtained from the fractionator column and the heavier hydrocarbon fraction from the quench column are measured and accordingly their ratio is adjusted so as to obtain the required values of these in the combined feed to the second stage or mode of coking. The variation of coke quality in different batches is also tackled through fine-tuning the ratio. These characterization parameters have been found to be reliable and the ratio of the feedstock constituents is adjusted prior to carrying out the second stage or mode delayed coking step to have certain characterization parameters within a predetermined range, which reliably results in high quality product prior to carrying out the delayed coking step.

The above said heavy petroleum fraction from the atmospheric distillation column is pre-heated to a temperature preferably of 200-400° C. and subsequently to a temperature preferably of 460-540° C. whereby the easily cokable material is converted to coke and subsequently heat soaked at this temperature for 10-20 minutes.

The heat soaked effluent is flashed into a coking drum until the coke level reaches the desired level in coking drum. After reaching coke at the desired level, a vapor is sent to the drum to maintain the drum temperature and to strip off all unconverted hydrocarbons present in the coke.

The cracked hydrocarbon vapors going out of the said coking drum is quenched in a small column called quench column. The quench media to be used is the middle distillate boiling above 250° C. from the said process. The condensed vapors along with coke fines go as a heavy petroleum fraction from quench column bottom. The uncondensed vapors from the quench column are then fed to a fractionator where it will be separated into different boiling fractions.

The heavy fractions from quench column bottom and fractionator are blended in definite ratio, which will depend on the characteristics of the individual streams, and processed in second stage or mode delayed coking. The said blend feed is pre-heated to a temperature preferably in the range of 250-350° C. and subsequently to a threshold temperature of 440-520° C. and heat soaking the said mixture for 10 to 20 minutes at this threshold temperature. The threshold temperature is the temperature at which the viscosity of the mesophase and gas formation is minimum, which will favor the formation of aligned needle structures. Above this threshold temperature, the viscosity of the mesophase and gas formation increases and coking occurs very rapidly, which leads to small mesophase structures having higher CTE. The said threshold temperature depends on the characteristics of the feed, recycle and drum pressure.

The heat soaked effluent is flashed into a coking drum until the coke level reaches the desired level in coking drum. After reaching coke at the desired level, a vapor is sent to the drum to maintain the drum temperature and to strip off all unconverted hydrocarbons present in the coke.

The cracked hydrocarbon vapors going out of the said coking drum is quenched in the said quench column. Middle distillate fraction boiling above 250° C. from the said process is used as quench media. The condensed vapors along with coke fines go as a heavy petroleum fraction from quench column bottom. The uncondensed vapors from the quench column are then fed to a fractionator where it will be separated into different boiling fractions.

The heaviest fraction obtained from the fractionator bottom is recycled along with the blend of quench column bottom and heavy fraction from fractionator or independently.

The coke produced by the above said process is calcined in a rotary calciner to complete the crystallization process started in the coking drum. The green petroleum coke is calcined at 1400° C. and subsequently graphitised at a temperature of 2800° C.

The present invention is described with reference to the following examples by the way of illustrations only and should not therefore be construed to limit the scope of the present work.

Example-1

This example illustrates the suitability of a particular feedstock for needle coke production under conventional delayed coking conditions. The feedstock used in this example is Atmospheric residue (AR) boiling 10 wt % below 400° C. obtained from atmospheric distillation of petroleum crude. The properties AR is given below:

| Properties AR | |
|---|---|
| Specific gravity, gm/cc | 0.9587 |
| CCR, wt % | 6.97 |
| Sulfur, wt % | 0.53 |
| Asphaltene, wt % | 2.37 |

The residue was preheated in a tubular heater under a pressure of 30-6 kg/cm$^2$ (g) to a final temperature of 490° C. and then continuously introduced into a coking drum operated at 2 kg/cm$^2$ (g) pressure, for a residence time of 24 hours to produce the coke.

The coking drum was then purged with superheated steam at about 450° C. to eliminate oils remained therein. The yield of the coke was found to be 19.3 wt % based on the residue feed. The petroleum coke obtained was tested for Coefficient of thermal expansion (CTE) and electrical resistivity after preparing graphite rod from the calcined coke. It is found that these value are $2.32\times10^{-6}$/° C. and 8400 μΩ·cm respectively. This shows that the coke produced from RCO is of non-crystalline type.

Example-2

This example has been considered to illustrate the change in coke properties if vacuum gas oil is extracted from the above said AR before processing in the Delayed coker unit. Vacuum residue having 10 wt % boiling below 510° C. obtained by processing the above said atmospheric residue in vacuum distillation column is used as feedstock in this case. The properties of the vacuum residue is given below:

| Properties VR | |
|---|---|
| Specific gravity, gm/cc | 1.035 |
| CCR, wt % | 17.89 |
| Sulfur, wt % | 1.84 |
| Asphaltene, wt % | 5.2 |

The above said short residue was processed in a Delayed coker unit under the process conditions explained in Example-1.

The yield of the coke was 24.0 wt % based on the residue feed. The petroleum coke obtained was tested for CTE and specific resistance after preparing graphite rod from the coke produced from the test. It is found that these values are $3.21\times10^{-6}$/° C. and 8700 μΩ·cm respectively. This clearly indicates that the coke produced from the vacuum residue is even inferior to that obtained from the atmospheric residue due to the higher concentration of readily cokable material.

Example-3

Atmospheric residue, which was explained in the Example-1, is processed under the same process conditions. The product obtained in this process is fractionated to gas, light distillate and a bottom hydrocarbon fraction. The bottom hydrocarbon fraction boiling 10 wt % below 370° C. is taken as the feed for the second mode of Delayed coking. Properties of the feed considered in this example is given below:

| Properties heavy HC fraction | |
|---|---|
| Specific gravity, gm/cc | 0.9493 |
| CCR, wt % | 6.97 |
| Sulfur, wt % | 0.46 |
| Asphaltene, wt % | 2.06 |

The residue was preheated in a tube heater under a pressure of 30-6 kg/cm$^2$ (g) to a temperature of 490° C. and then continuously introduced into a coking drum, for a residence time of 24 hours to produce the coke and subsequently the coking drum was purged with superheated steam at about 450° C. to eliminate volatile hydrocarbons retained in the coke.

The yield of the coke in second mode was 15.0% based on the feed. The petroleum coke obtained was almost amorphous and Coefficient of thermal expansion (25-525° C.) direction parallel to the extrusion was $1.97\times10^{-6}$/° C.

Example-4

This example shows the effect of blending of the bottom hydrocarbon fraction of the 1$^{st}$ mode of coking as described in the previous example with atmospheric residue on the production of needle coke. Atmospheric residue used in the Example 1 is considered as feedstock for the first Delayed coking in this Example also. The distillate obtained in this process is fractionated to gas, light distillate and a heavy bottom fraction.

Three different blends of above said bottom hydrocarbon fraction boiling 10 wt % below 370° C. and the feed to the first mode delayed coking (Atmospheric residue) have been tried as the feed for the second mode of Delayed coking. The composition (wt %) and properties of these blends are summarized in Table-1. The foresaid feed was preheated in a tube heater under a pressure of 2 kg/cm$^2$ (g) to 490° C. and then continuously introduced into a coking drum, for a residence time of 24 hours to produce the coke. The coking drum was subsequently purged with superheated steam at about 450° C. to eliminate volatile hydrocarbons retained in the coke.

| | Blend 1 | Blend 2 | Blend 3 |
|---|---|---|---|
| Composition of feed | | | |
| Atmospheric residue, wt % | 90 | 50 | 10 |
| Fractionator bottom, wt % | 10 | 50 | 90 |
| Properties of feed | | | |
| Specific gravity (at 15° C.) | 0.9578 | 0.9540 | 0.9502 |
| CCR, wt % | 6.723 | 5.735 | 4.747 |
| Sulfur content, wt % | 0.523 | 0.495 | 0.467 |
| Asphaltene content, wt % | 2.339 | 2.215 | 2.091 |
| Coke yield, wt % | 17.8 | 16.4 | 15.7 |
| CTE of coke $\times10^6$/° C. | 2.23 | 2.13 | 2.02 |
| Electrical resistivity, μΩ-cm | 6100 | 5400 | 4900 |

Example-5

Feedstock and process conditions used in the Example-1 were used for the first mode coking described in this example. The distillate vapor produced in this mode is quenched in a small quench column where all the coke fines and heavier fractions are removed. The rest of the vapor is fed to a fractionator where gas, light distillate and a heavy bottom fraction are departed out.

In the second mode of Delayed coking, a combined feed of quench column bottom and main column bottom is used. The coke fines are removed from quench column bottom using strainers before it is used in the second mode. Three different blends of above said quench column bottom boiling 10 vol % below 410° C. and the fractionator column bottom of the first mode delayed coking boiling 10 vol % below 390° C. have been tried as the feed for the second mode of Delayed coking. The composition (wt %) and properties of these blends are summarized in Table-2. The residue was preheated in a tube heater under a pressure of 30-6 kg/cm$^2$ (g) to 490° C. and then continuously introduced into a coking drum, for a residence time of 24 hours to produce the coke. The coking drum was purged with superheated steam at about 450° C. to eliminate volatile hydrocarbons retained in the coke.

The yield of the coke in second mode was 15-21 wt % based on the feed. The petroleum coke obtained had a physical appearance of needle like shape. It has been analyzed for CTE and all other important properties. The analysis result is summarized in Table-2. From the result it is confirmed that the coke produced from blend-1 meets all needle coke specification. The real density, particle density, ash, VMC, sulfur, etc. are determined after calcination of raw petroleum coke and the coefficient of thermal expansion and specific resistance is determined after making the graphite rod from calcined coke.

| | Blend 1 | Blend 2 | Blend 3 |
|---|---|---|---|
| Composition of feed | | | |
| Quench column bottom, wt % | 90 | 50 | 10 |
| Fractionator bottom, wt % | 10 | 50 | 90 |
| Properties of feed | | | |
| Specific gravity (at 15° C.) | 0.9966 | 0.975 | 0.9543 |
| CCR, wt % | 9.146 | 5.57 | 1.994 |
| Sulfur content, wt % | 0.6 | 0.54 | 0.48 |
| Asphaltene content, wt % | 1.88 | 1.96 | 2.04 |
| Coke yield, wt % | 21.4 | 19.2 | 15.3 |
| Properties of coke | | | |
| Real density, g/cc | 2.15 | 2.15 | 2.15 |
| Ash, wt % | 0.07 | 0.05 | 0.04 |
| VMC, wt % | 0.26 | 0.32 | 0.28 |
| Sulfur, wt % | 0.53 | 0.48 | 0.39 |
| CTE $\times 10^6$,/° C. | 0.98 | 1.28 | 1.47 |
| Electrical resistivity, μΩ-cm | 800 | 1600 | 3500 |

Therefore, ratio of blending of the quench column bottom and heavy fractionator bottom to meet the predetermined characteristics is important to produce the needle coke having very low CTE.

The invention claimed is:

1. A process for preparing crystalline petroleum coke having needle like structure suitable for manufacturing high temperature graphite electrodes from atmospheric residue obtained from bottom of atmospheric crude distillation column, said process comprising the steps:

a. preheating the atmospheric residue to a temperature in the range of 440° to 520° C. to obtain a hydrocarbon stream in which thermal cracking has been initiated;

b. subjecting the hydrocarbon stream in which thermal cracking has been initiated thus obtained in step (a) to a first delayed coking step in a first coking column to form cracked hydrocarbon vapors and easily cokable material and separating the easily cokable material from the cracked hydrocarbon vapors as solid coke;

c. adding quench stream to the cracked hydrocarbon vapors obtained in step (b) in a quench column to obtain a condensate containing heavier hydrocarbon fraction and vapors containing lighter hydrocarbon fractions;

d. separating the vapor containing lighter hydrocarbon fractions into at least a gas component and a hydrocarbon fraction having true boiling point in the range of 380° C. to 480° C. in a first distillation column;

e. mixing the condensate obtained in the step (c), the hydrocarbon fraction having boiling point in the range of 380° C. to 480° C. thus obtained in step (d) and optionally clarified oil (CLO) obtained from FCC process and/or thermal tars and/or aromatic extract to obtain a mixture having aromatics content greater than or equal to 60% and average aromatic ring per molecule in the range of 3 to 8;

f. subjecting the mixture thus obtained in step (e) to a temperature in the range of 460° C. to 540° C. in a preheater in presence of steam to obtain a hydrocarbon stream in which thermal cracking has been initiated; and g. subjecting the hydrocarbon stream in which thermal cracking has been initiated thus obtained in step (f) to a second delayed coking step in a second coking column thereby obtaining crystalline petroleum coke having needle structure and a cracked hydrocarbon product mixture and separating the crystalline petroleum coke having needle structures.

2. A process as claimed in claim 1, wherein the atmospheric residue contains sulfur less than or equal to 0.7 wt %, conradson carbon residue less than or equal to 12 wt % and aromatics content greater than or equal to 25 wt %.

3. A process as claimed in claim 1, wherein in step (b), delayed coking is carried out in the first coking column under pressure in the range of 1 to 10 kg/cm$^2$ (g).

4. A process as claimed in claim 1, wherein in step (b), delayed coking is carried out for a cycle time in the range of 16 to 32 hrs.

5. A process as claimed in claim 1, wherein the content of n-heptane insoluble molecules of the mixture of step (e) is not more than 0.5 wt %.

6. A process as claimed in claim 1, wherein any entrained coke particles in the hydrocarbon fraction obtained from the bottom of the quench column is removed through filtration or centrifugation or both.

7. A process as claimed in claim 1, wherein in step (g), the pressure in the second coking column is in the range of 2 to 20 kg/cm$^2$ (g).

8. A process as claimed in claim 1, wherein in step (g), the velocity of the entering hydrocarbon fraction in the second coking column is in the range of 20 to 200 feet/sec.

9. A process as claimed in claim 1, wherein in step (g), the steam is passed through the second coking column after switching off the flow of the heated mixture of step (f) for a period not less than 2 hrs.

10. A process as claimed in claim 9, wherein the velocity of the steam in the second coking column is kept in the range of 4 to 14 feet/sec.

11. A process as claimed in claim 1, wherein the first and second coking and distillation columns may be physically same, but the operations are carried out in two different modes.

12. A process as claimed in claim 1, wherein quench stream used in step (c) for quenching the cracked hydrocarbon vapors from the first delayed coking column is obtained from the first distillation column.

13. A process as claimed in claim 1, wherein the bottom fraction obtained from distilling the cracked hydrocarbon mixture of step (g) is recycled with the fresh feed to the second delayed coking step in an amount in the range of 0.1 to 2 wt %.

14. A process as claimed in claim 1, wherein the hydrocarbon product mixture obtained in step (g) is separated in a second distillation column into gas, LPG, naphtha, gas oil, and a heavier stream from the bottom.

* * * * *

UNITED STATES PATENT AND TRADEMARK OFFICE

CERTIFICATE OF CORRECTION

PATENT NO. : 7,604,731 B2
APPLICATION NO. : 10/892024
DATED : October 20, 2009
INVENTOR(S) : Bhattacharyya et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 246 days.

Signed and Sealed this

Fifth Day of October, 2010

David J. Kappos

David J. Kappos
*Director of the United States Patent and Trademark Office*